US011692522B2

(12) United States Patent
Zheng et al.

(10) Patent No.: US 11,692,522 B2
(45) Date of Patent: Jul. 4, 2023

(54) SPARK PLUG HEAT UP METHOD VIA TRANSIENT CONTROL OF THE SPARK DISCHARGE CURRENT

(71) Applicants: WEICHAI TORCH TECHNOLOGY CO., LTD., Hunan (CN); CLEAN COMBUSTION ENGINE TECHNOLOGY INC., Ontario (CA)

(72) Inventors: Ming Zheng, Ontario (CA); Guangyun Chen, Hunan (CN); Xiao Yu, Ontario (CA); Qingyuan Tan, Ontario (CA); Meiping Wang, Ontario (CA); Tangliang Zhang, Hunan (CN); Jin Qian, Hunan (CN)

(73) Assignees: WEICHAI TORCH TECHNOLOGY CO., LTD., Hunan (CN); CLEAN COMBUSTION ENGINE TECHNOLOGY INC., Ontario (CA)

( * ) Notice: Subject to any disclaimer, the term of this patent is extended or adjusted under 35 U.S.C. 154(b) by 224 days.

(21) Appl. No.: 17/381,188

(22) Filed: Jul. 20, 2021

(65) Prior Publication Data

US 2021/0348588 A1 Nov. 11, 2021

Related U.S. Application Data

(63) Continuation-in-part of application No. PCT/CN2019/123700, filed on Dec. 6, 2019.

(51) Int. Cl.
*F02P 3/08* (2006.01)
*F02P 3/09* (2006.01)
(Continued)

(52) U.S. Cl.
CPC ..... *F02P 3/0838* (2013.01); *F02P 3/093* (2013.01); *H01T 13/14* (2013.01); *H01T 13/18* (2013.01); *H01T 13/20* (2013.01); *H01T 13/58* (2013.01)

(58) Field of Classification Search
CPC ..... F02P 3/0838; F02P 3/093; F02P 3/0456; F02P 3/053; F02P 11/00; F02P 17/12;
(Continued)

(56) References Cited

U.S. PATENT DOCUMENTS

2003/0006775 A1 1/2003 Wright
2011/0239998 A1 10/2011 Aida et al.

FOREIGN PATENT DOCUMENTS

CN 101037968 9/2007
CN 101843168 9/2010
(Continued)

OTHER PUBLICATIONS

"International Search Report (Form PCT/ISA/210) of PCT/CN2019/123700," dated Aug. 19, 2020, pp. 1-4.
(Continued)

*Primary Examiner* — Hai H Huynh
(74) *Attorney, Agent, or Firm* — JCIP Global Inc.

(57) ABSTRACT

A spark plug heat up method via transient control of the spark discharge current. The high temperature plasma channel is used to heat up the central electrode, and the temperature and energy of the plasma channel are realized via transient control of the discharge current. The heating up process takes place before firing the engine, using discharge current to actively heat up the spark plug from inside. By monitoring the discharge current amplitude and discharge duration, the temperature change of the central electrode and the ceramic insulator can be carefully measured and controlled within a proper window. This method can be used to
(Continued)

measure the heating range of the spark plug, and to prevent or remove the carbon deposit on the central electrode and the ceramic insulator generated under various engine operation conditions, such as engine cold start, full load operation, and heavy EGR condition, as well as realize self-cleaning.

13 Claims, 4 Drawing Sheets

(51) Int. Cl.

| | |
|---|---|
| ***H01T 13/14*** | (2006.01) |
| ***H01T 13/18*** | (2006.01) |
| ***H01T 13/20*** | (2006.01) |
| ***H01T 13/58*** | (2020.01) |

(58) Field of Classification Search

CPC ..... H01T 13/14; H01T 13/18; H01T 13/20; H01T 13/58

USPC ..... 123/600, 601, 605, 618, 630, 169 CL, 123/169 PB, 143 B

See application file for complete search history.

(56) References Cited

FOREIGN PATENT DOCUMENTS

| | | | | |
|---|---|---|---|---|
| CN | 101910615 | | 12/2010 | |
| CN | 108512036 | | 9/2018 | |
| DE | 102014013513 | * | 3/2016 | ..... F02P 17/12 |
| EP | 2012001 | | 1/2009 | |

OTHER PUBLICATIONS

"Written Opinion of the International Searching Authority (Form PCT/ISA/237) of PCT/CN2019/123700," dated Aug. 19, 2020, pp. 1-4.

* cited by examiner

SPARK PLUG HEAT UP METHOD VIA TRANSIENT CONTROL OF THE SPARK DISCHARGE CURRENT

CROSS-REFERENCE TO RELATED APPLICATION

This application is a continuation in part of international PCT application serial no. PCT/CN2019/123700, filed on Dec. 6, 2019. The entirety of the above-mentioned patent application is hereby incorporated by reference herein and made a part of this specification.

BACKGROUND

Technical Field

The present invention generally relates to a spark plug heat up method, which controls the temperature of the central electrode of a spark plug by controlling the discharge current amplitude and discharge duration of a spark event. The method uses real time discharge current feedback to control the discharge current during the heating up process, including discharge current amplitude, discharge duration and total discharge energy. The heat range of the spark plug can also be measured by monitoring the temperature profile of the central electrode.

Description of Related Art

Spark plug is one of the key components for spark ignition (SI) engine. It mainly consists of central electrode, ceramic insulator, and metal shell. The spark gap is formed between the ground electrode on the metal shell and the central electrode, and is driven by the ignition coil to generate a spark to ignite the combustible gas mixture in the combustion chamber. During the combustion process, apart from the combustion heat being converted into useful work and exhaust waste heat, about one third of the heat is absorbed by the cylinder wall. Water jacket cooling chamber is arranged outside the cylinder wall to dissipate the heat and maintain the temperature of the cylinder wall. The spark plug is normally installed at the top of the combustion chamber, and the central electrode is insulated from the cylinder wall. With discharge current and the high in-cylinder temperature, the temperature of the central electrode is significantly higher than the temperature of the cylinder wall. The heat accumulated on the central electrode can only be dissipated through the ceramic insulator to the metal shell of the spark plug.

During SI engine operations, the temperature of the central electrode and the surrounding ceramic insulator should be kept with an appropriate range. The heat range of a spark plug is an industrial standard to describe the heat dissipation capability of a spark plug. A hotter spark plug leads to a higher temperature of the central electrode. Overheated central electrode can cause pre-ignition. Pre-ignition is defined as auto ignition of the combustible gas mixture near compression top dead center before the ignition event, and spark timing cannot control combustion phasing under such phenomenon. Severe pre-ignition events can trigger super knocking, causing major damage to the engine. A colder spark plug can have much lower temperature of the central electrode, which can lead to carbon deposit accumulation. Carbon deposit accumulation on the surfaces of the central electrode and the ceramic insulator are likely to be produced under operating conditions such as engine cold start, full load operation and higher exhaust gas recirculation. The carbon deposit can grow along the surface of the ceramic insulator to cause electric creepage, compromising the ignition capability of the spark plug; the carbon deposit also can fill in the spark gap, causing ignition failure. With the technical development of internal combustion engine, both engine rotation speed and engine load are increasing to meet the need among various applications. For different engine operation characteristics, a spark plug with proper heat range is essential for stable engine operation.

Based on present patent retrieval, no identical patent publication is found compared with the present invention. Some of the patent remotely related to the present patent is listed below:

1. Reference Patent CN 200880113816.8 exposed a ceramic heater and a spark plug containing the ceramic heater. The patent proposed a spark plug with a ceramic heater, and a pair of opposed portions with heating resistors juxtaposed, a pair of leading wire which connected with the heating resistors, a ceramic base which holds the above mentioned heating resistors and leading wire. Between the opposed portions, a component with thermal conductivity higher than ceramic base is placed. The heating effect of the proposed solution is not sufficient to heat up the spark plug electrode quickly. Cold start process demands fast heating up the electrode of the spark plug, especially when ambient temperature is cold. The slow heat transfer rate of the ceramic resistor will further decrease the heating effect of the electrode.

2. Reference Patent CN 201710112897.0 exposed a spark plug with induction heating components embedded into the spark plug to heat up the electrodes and ceramic insulator before the ignition event. Such structure demands redesign of the spark plug. The heating principle is different from the present invention, and has limited capability to control the electrode temperature precisely.

3. Reference Patent US90055301 descript a "System for measuring spark plug suppressor resistance under simulated operating conditions". The patent exposed a method using high voltage to heat up the built-in resistor in the spark plug, in order to measure the spark plug resistance more accurately. This is because the actual resistance of the spark plug during engine operation is important to benchmark the spark energy, and such system can avoid the errors in spark energy estimation due to the temperature change of the spark plug. Compare with the present patent, the reference patent doesn't consider using plasma as a heating source to heat up the electrode. The heat dissipation path will also be different compared with real application, so the heat range of the spark plug cannot be measured via the method provided by the reference patent. Furthermore, because of the transient nature of the plasma channel, a fast, real-time close-loop control algorithm is needed to control the plasma discharge. A high voltage power source alone will not be sufficient to realize the control of the discharge process.

The existing patents regarding spark plug heating involve development of the spark plug with new structure. None of the patents can realize the transient control of the temperature of the electrode of spark plug. A detailed control algorithm is also not provided. More effort is needed to tackle the carbon deposit problem for spark plugs and heat range benchmarking.

Technical Problem

From the above description, the ability to actively heat up the spark plug is important for both heat range benchmarking and preventing carbon deposit formation. The heat range is normally benchmarked by pre-ignition event during engine operation. A specific engine is needed to operate for long hours under specific coolant temperature and engine load using specific types of fuel and engine oil. To avoid spark plug fouling by carbon deposit normally demands special electrode material and redesign the structure of the spark plugs. However, the boundary condition during engine operation is complicated, with constant change of air fuel ratio and mixing quality. Active methodology is needed to simplify the heat range benchmarking procedure as well as preventing the formation of carbon deposit at the spark gap.

SUMMARY

The aim of the present invention is to actively control the discharge current duration and discharge current amplitude to realize precise and real-time control of the temperature of the central electrode of a spark plug. Such method is useful to prevent carbon accumulation deposit on the electrodes of the spark plug, as well as burning off the carbon deposit after it is formed.

The method is also useful to benchmark the heat range of the spark plug.

The present invention provides a spark plug heat up method via transient control of the spark discharge current. The high temperature plasma channel is used to heat up the central electrode, and the temperature and energy of the plasma channel are realized by transient control of discharge current. By actively heating up the spark plug via transient control of discharge current, the temperature of the surfaces of central electrode and surrounding ceramic insulator can be controlled within a proper window, avoiding carbon deposit as well as realize self-cleaning. The heating up process takes place before firing the engine, using discharge current to heat up the spark plug from inside. By monitoring the discharge current amplitude and discharge duration, the temperature change of the central electrode and the surrounding ceramic insulator can be carefully measured and controlled. This method can be used to measure the heating range of the spark plug, as well as cleaning the carbon deposit on the surfaces of ceramic insulator and central electrode. The invention can actively heat up the spark plug via transient control of the discharge current, providing a method to control the temperature of the spark plug within a preferable temperature window, can be used to prevent or remove the generated carbon deposit.

Moreover, discharge current is used to heat up the spark plug from inside with precise control over the discharge duration and discharge current amplitude, in order to heat up the electrodes of the spark plug and ceramic insulator. The spark plug can be heated up before engine start to avoid carbon deposit accumulation during engine cold start.

Moreover, an electric circuit is proposed to realise the real-time control over the discharge process, guarantee a stable discharge process. The discharge current profile is used as a feedback signal to realise close loop control over the discharge current amplitude and discharge energy. The spark plug can be heated up actively during engine operation to clean up the carbon deposit on the spark plug.

Moreover, discharge current profile is precisely controlled to deliver same amount of discharge energy to heat up the central electrode of the spark plug. The temperature profile of the central electrode and the ceramic insulator can reflect the heat range of a spark plug, providing a possible solution for heat range benchmarking of the spark plug.

The discharge energy is controlled by the control of discharge current amplitude and discharge duration. A real-time controller is used to control the charging and discharging process of the ignition coil, as well as the discharge duration and discharge current amplitude. The real-time control can be, but not limited to FPGA system, microcontroller system, and so on.

A detailed operation procedure is explained below based on a discharge current feedback close loop control method.

1. An ignition command is generated by real-time controller to charge the ignition coil, in order to generate a breakdown event at the spark gap.

2. After the discharge channel is established, a second switch is closed to adjust discharge current to the setting value via a second capacitor.

3. Because of the voltage potential difference between the second capacitor and a first capacitor, a first capacitor is charged up by the second capacitor when the second switch is closed. The upstream voltage of the spark plug can be adjusted this way to control the discharge current amplitude dynamically. When the second switch is open, the first capacitor is used as a voltage buffer to continue supply current to the spark gap on the spark plug. The voltage potential of the first capacitor, i.e. the voltage of spark gap, is controlled by the operation frequency and duty cycle of the second switch. The discharge current amplitude is adjusted by the voltage potential of the first capacitor.

4. When the second switch is closed, the second capacitor will discharge to the first capacitor as well as the spark gap; when the second switch is open, only the first capacitor will discharge to the spark gap.

The second capacitor acts as an energy storage device to deliver energy to the first capacitor and spark gap, and has a relative larger capacitance compared with the first capacitor. The capacitance of the second capacitor is around 1~2 μF. The main function of the second capacitor is to stabilize voltage at the secondary side of the bridge rectifier 20, and guarantee a stable upstream voltage for the downstream discharge circuit. The capacitance of the first capacitor is around 100 nF, and its main function is to stabilize the discharge current across the spark gap. If the capacitance of the first capacitor is too small, the discharge current cannot be stabilized because of the limited energy storage capacity of the first capacitor. If the capacitance of the first capacitor is too large, a transient voltage adjustment across the spark gap is not possible, leading to failure for transient control of discharge current.

A direct current measurement module is used to send actual discharge current to the real-time controller as a feedback signal to realize close-loop control of the discharge current. The control strategies that can be applied for the transient control of spark discharge current includes but not limited to, the Proportional-Integral-Derivative (PID) control, data-driven nonlinear model predictive control, data-driven adaptive model guided control, data-driven nonlinear model guided optimization, and the adaptive model feed-forward control which speeds up the system's transient response.

Moreover, the third switch is placed between the first capacitor and the ground. When the third switch is closed, the first capacitor can discharge to the ground actively to reduce the voltage potential. With proper opening and closing sequence of the second switch and the third switch, the voltage potential of the first capacitor can be precisely controlled, in order to control the spark discharge current amplitude.

Moreover, to further enhance the accuracy of the measured feedback discharge current and suppress the influence of the electric noise originated from the spark discharge released from the spark plug, a Hall Effect sensor was selected to provide discharge current measurement. The Hall Effect sensor is isolated from the ground which separates the measurement circuit with the target circuit. Instrumentation amplifiers are used as signal conditioner to improve the signal to noise ratio of the feedback current measurement.

Moreover, the heating of the spark plug, which is accomplished utilizing the transient control of spark discharge current, has the following characteristics: the power of the discharged spark is applied as the feedback for the control of the discharge current profile. By using the measured high voltage feedback signal and the discharge current signal, the power of the discharged spark can be estimated in real-time. The voltage and current measurement are physically acquired at the same point: the terminal of the spark plug. The real-time estimate of the power of the discharged spark can be used as a performance factor to control the heating of the central electrode of the spark plug.

Moreover, the heating of the spark plug, which is accomplished utilizing the transient spark discharge current control, has the following characteristics: the control of the spark discharge current amplitude and the spark discharge duration are realized through nonlinear feedback control. The cost function is designed using the selected system performance parameters. The detailed controller design steps are elaborated below:

1) Identify the desired reference trajectory for the feedback control. The trajectory is designed based on but not limited to the following parameters: the desired spark discharge current profile, the spark discharge current amplitude, the change rate of discharge current of the spark, and the discharge duration of the spark.

2) Measure the spark discharge current in real time.

3) Use the designed model to predict the spark discharge current.

4) Determine the transient and steady state requirement for the control system: e.g. the desired response rise time, the system overshoot allowance, and the bounds for the steady state error.

5) Use the nonlinear controller to derive the control parameters based on the nonlinear cost function.

6) To improve the transient performance of the system, an adaptive feedforward model can be used to derive a control correction based on the desired reference trajectory. The model parameters are optimized in real-time using the related measurement acquired in 1), hence the accuracy of the model prediction is improved. The ideal control input to the system can be derived using the optimized model. The final control input applied to the system is the combination of the ideal control input and the control input derived by the nonlinear feedback controller.

7) The system would generate different discharge current profiles based on the control input values. The discharge current feedback measurement is sent to both the feedforward model and the data-driven nonlinear model embedded in the nonlinear controller. Both models are optimized using the real-time measurement. The data-driven nonlinear model predicts the system output. Both the model prediction and the real-time feedback measurement are applied to the cost function.

BRIEF DESCRIPTION OF THE DRAWINGS

A better understanding of the present invention will be had upon reference to the following detailed description when read in conjunction with the accompanying drawing schematic.

DESCRIPTION OF THE EMBODIMENTS

Embodiment 1

Figure 3:
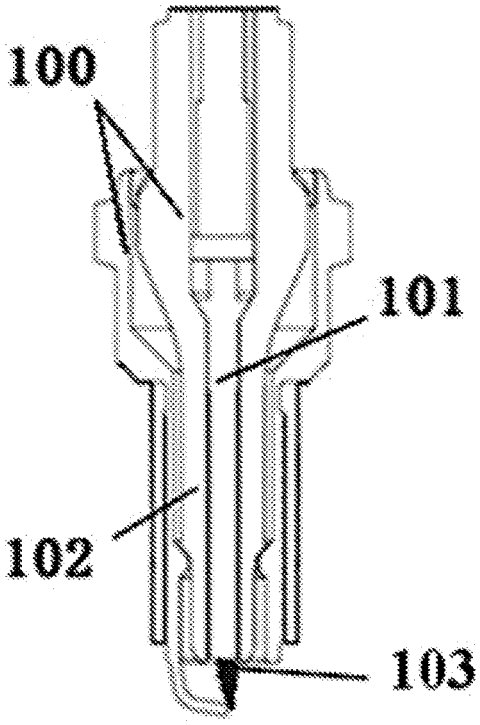
FIG. 3 is the structure of a typical spark plug used in the present invention.
Figure 4:
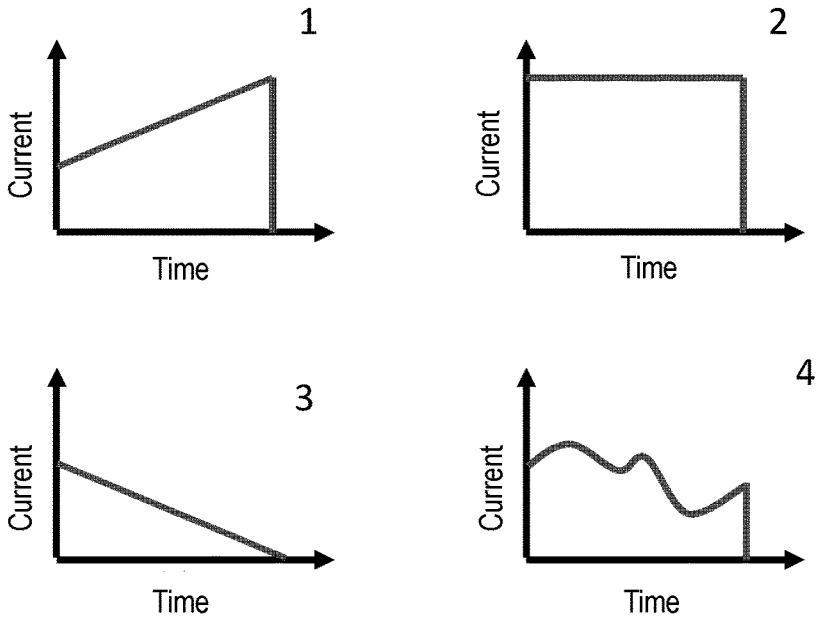
FIG. 4 is a demonstration of possible discharge current profile realized by the proposed discharge current control method.

The present invention involves a spark plug heat up method via transient control of the spark discharge current. With reference to FIG. 3, the high temperature plasma channel 103 is used to heat up the central electrode 101, and the temperature and energy of the plasma channel 103 are monitored by transient control of discharge current amplitude and discharge duration. By monitoring the discharge current amplitude and discharge duration, the temperature change of the central electrode 101 and the surrounding ceramic insulator 102 can be carefully measured and controlled. This method can be used to measure the heat rating of the spark plug 100. By actively heating up the spark plug 100 via transient control of discharge current, the temperature of the surfaces of the central electrode 101 and the surrounding ceramic insulator 102 can be precisely controlled within a proper window, avoiding carbon deposit as well as realize self-cleaning.

The heating up process can start before firing the engine, using discharge current to heat up the spark plug 100 from inside, as well as cleaning the carbon deposit on the surfaces of ceramic insulator 102 and central electrode 101.

Figure 1:
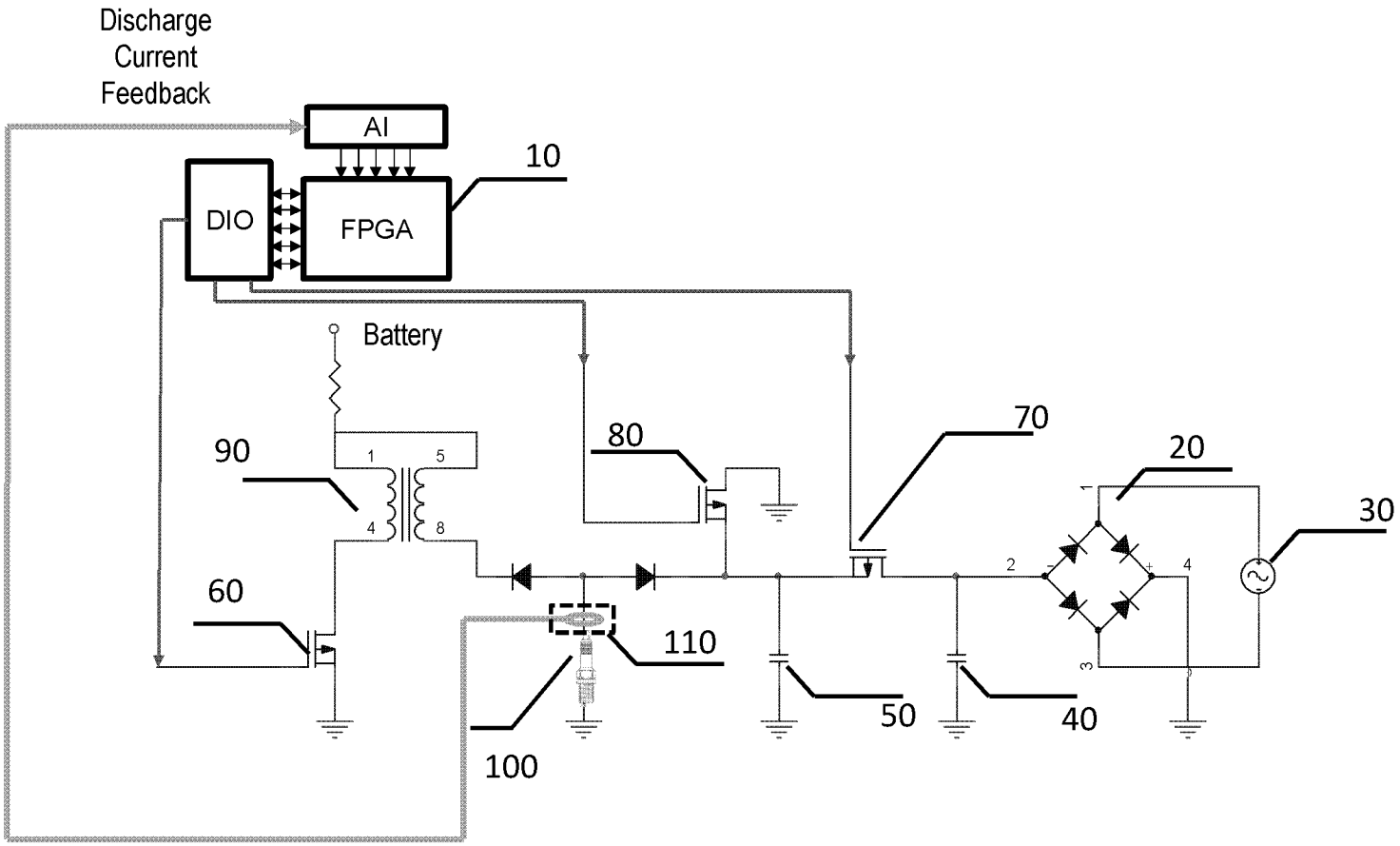
FIG. 1 is the schematic of the electric circuit of the system for transient control of discharge current.

The real-time control over the discharge current and discharge energy to spark plug 100 is realized by an electric circuit with reference to FIG. 1. The ignition system consists of spark initiation circuit, power supply system for the discharge event, and a real-time control circuit. The spark initiation circuit consist of ignition coil 90 and the first switch 60. The function of this circuit is to generate enough high voltage on the spark gap to establish the plasma channel. The power supply system consists of an insulated high voltage transformer 30, a rectifier bridge 20, a second capacitor 40, a first capacitor 50, and a second switch 70. Rectifier bridge 20 can convert the AC output of the insulated high voltage transformer 30 into DC voltage, and then charge up the second capacitor 40. When the second switch 70 is closed, the second capacitor 40 can discharge to the spark gap to boost up the discharge current. The control circuit based on real-time controller 10 is used to control the discharge timing of the ignition coil, the discharge duration, as well as discharge current amplitude.

A detailed operation procedure is explained below based on a discharge current feedback close loop control method.

1. An ignition command is generated by real-time controller 10 to close the first switch 60, in order to charge the ignition coil 90. At the end of the charging process, the first switch 60 is open to cut off the primary current, in order to generate a breakdown event at the spark gap.

2. After the discharge channel is established, the second switch 70 is closed to adjust discharge current to the setting value via the second capacitor 40.

3. Because of the voltage potential difference between the second capacitor 40 and the first capacitor 50, the first capacitor 50 is charged up by the second capacitor 40 when the second switch 70 is closed. The upstream voltage of the spark plug 100 can be adjusted to control the discharge current amplitude dynamically. When the second switch 70 is open, the first capacitor 50 is used as a voltage buffer to continue supply current to the spark gap on the spark plug 100. The voltage potential of the first capacitor 50, i.e. upstream voltage of the spark plug 100, is controlled by the operation frequency and duty cycle of the second switch 70. The discharge current amplitude is adjusted by the voltage potential of the first capacitor 50.

4. When the second switch 70 is closed, the second capacitor 40 will discharge to the first capacitor 50 as well as the spark gap; when the second switch 70 is open, only the first capacitor 50 will discharge to the spark gap.

5. During operation, direct current measurement module 110 report the discharge current amplitude data to real-time controller 10 as a feedback signal. The real-time controller 10 uses the second switch 70 to adjust the voltage potential flow through spark plug 100 by adjusting the operation frequency and duty cycle of the second switch 70, and the discharge current profile and discharge duration is properly controlled.

The second capacitor 40 acts as the energy storage device to deliver energy to the first capacitor 50 and spark gap, and has a relative larger capacitance compared with first capacitor 50. The capacitance of the second capacitor 40 is around 1~2 μF. The main function of the second capacitor 40 is to stabilize voltage at the secondary side of the bridge rectifier 20, and guarantee a stable upstream voltage for the downstream discharge circuit. The capacitance of the first capacitor 50 is around 100 nF, and its main function is to stabilize the discharge current across the spark gap. If the capacitance of the first capacitor 50 is too small, the discharge current cannot be stabilized because of the limited energy storage capacity of the first capacitor 50. If the capacitance of the first capacitor 50 is too large, a transient voltage adjustment across the spark gap is not possible, leading to failure for transient control of discharge current.

Figure 2:
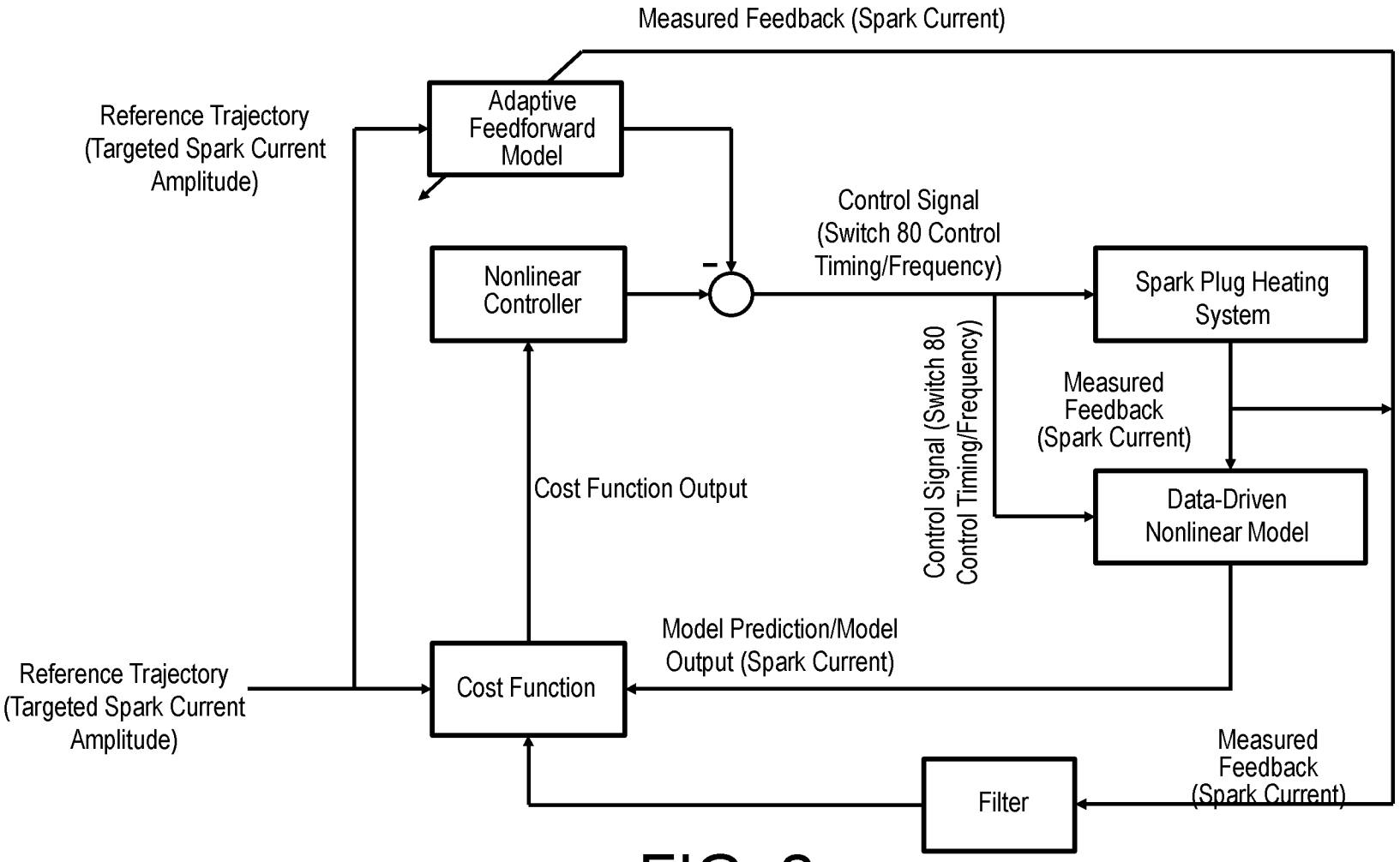
FIG. 2 is the block diagram of the working principle of non-liner control method.

The control strategies that can be applied includes but not limited to, the Proportional-Integral-Derivative (PID) control (as shown in FIG. 2), data-driven nonlinear model predictive control (nonlinear model predictive control using models such as neural network models, Wiener model, and Sandwich model), data-driven adaptive model guided control, data-driven nonlinear model guided optimization, and the adaptive model feedforward control which speeds up the system's transient response. The spark plug heating system is controlled based on the proposed data-driven nonlinear model adaptive control method, the reference trajectory (the targeted spark amplitude) is sent to both the feedforward model and the cost function. After being optimized by the cost function, the reference trajectory is sent to the nonlinear controller. The final control input applied to the spark plug heating system is the combination of the ideal control input derived by the feedforward model and the control input derived by the nonlinear feedback controller. The measured feedback together with the final control input are sent to the data-driven nonlinear model, which both the model output and the measured feedback are used for the model optimization. As a result, the model is adaptively adjusted online, hence the nonlinear controller becomes an adaptive nonlinear controller.

Embodiment 2

Embodiment 2 has similar operation principle as embodiment 1, with difference in discharge current control algorithm.

The present invention involves a spark plug heat up method via transient control of the spark discharge current. With reference to FIG. 3, the high temperature of plasma channel 103 is used to heat up the central electrode 101, and the temperature and energy of the plasma channel 103 are monitored by transient control of discharge current amplitude and discharge duration. By monitoring the discharge current amplitude and discharge duration, the temperature change of the central electrode 101 and the surrounding ceramic insulator 102 can be carefully measured and controlled. This method can be used to measure the heat rating of the spark plug 100. By actively heating up the spark plug 100 via transient control of discharge current, the temperature of the surfaces of the central electrode 101 and the surrounding ceramic insulator 102 can be precisely controlled within a proper window, avoiding carbon deposit as well as realize self-cleaning.

The heating up process can start before firing the engine, using discharge current to heat up the spark plug 100 from inside, as well as cleaning the carbon deposit on the surfaces of ceramic insulator 102 and central electrode 101.

The real-time control over the discharge current and discharge energy to spark plug 100 is realized by an electric circuit with reference to FIG. 1. The ignition system consists of spark initiation circuit, power supply system for the discharge event, and a real-time control circuit. The spark initiation circuit consist of ignition coil 90 and the first switch 60. The function of this circuit is to generate enough high voltage on the spark gap to establish the plasma channel. The power supply system consists of an insulated high voltage transformer 30, a rectifier bridge 20, a second capacitor 40, a first capacitor 50, and a second switch 70. Rectifier bridge 20 can convert the AC output of the insulated high voltage transformer 30 into DC voltage, and then charge up the second capacitor 40. When the second switch 70 is closed, the second capacitor 40 can discharge to the spark gap to boost up the discharge current. The control circuit based on real-time controller 10 is used to control the discharge timing of the ignition coil, the discharge duration, as well as discharge current amplitude.

A detailed operation procedure is explained below based on a discharge current feedback close loop control method.

1. An ignition command is generated by real-time controller 10 to close the first switch 60, in order to charge the ignition coil 90. At the end of the charging process, the first switch 60 is open to cut off the primary current, in order to generate a breakdown event at the spark gap.

2. After the discharge channel is established, the second switch 70 is closed to adjust discharge current to the setting value via the second capacitor 40.

3. Because of the voltage potential difference between the second capacitor 40 and the first capacitor 50, the first capacitor 50 is charged up by the second capacitor 40 when the second switch 70 is closed. The upstream voltage of the spark plug 100 can be adjusted to control the discharge current amplitude dynamically. When the second switch 70 is open, the first capacitor 50 is used as a voltage buffer to continue supply current to the spark gap on the spark plug 100. The voltage potential of the first capacitor 50, i.e. upstream voltage of the spark plug 100, is controlled by the operation frequency and duty cycle of the second switch 70.

The discharge current amplitude is adjusted by the voltage potential of the first capacitor 50.

4. When the second switch 70 is closed, the second capacitor 40 will discharge to the first capacitor 50 as well as the spark gap; when the second switch 70 is open, only the first capacitor 50 will discharge to the spark gap.

5. During operation, direct current measurement module 110 report the discharge current amplitude data to real-time controller 10 as a feedback signal. The real-time controller 10 uses the second switch 70 to adjust the voltage potential flow through spark plug 100 by adjusting the operation frequency and duty cycle of the second switch 70, and the discharge current profile and discharge duration is properly controlled.

Figure 5:
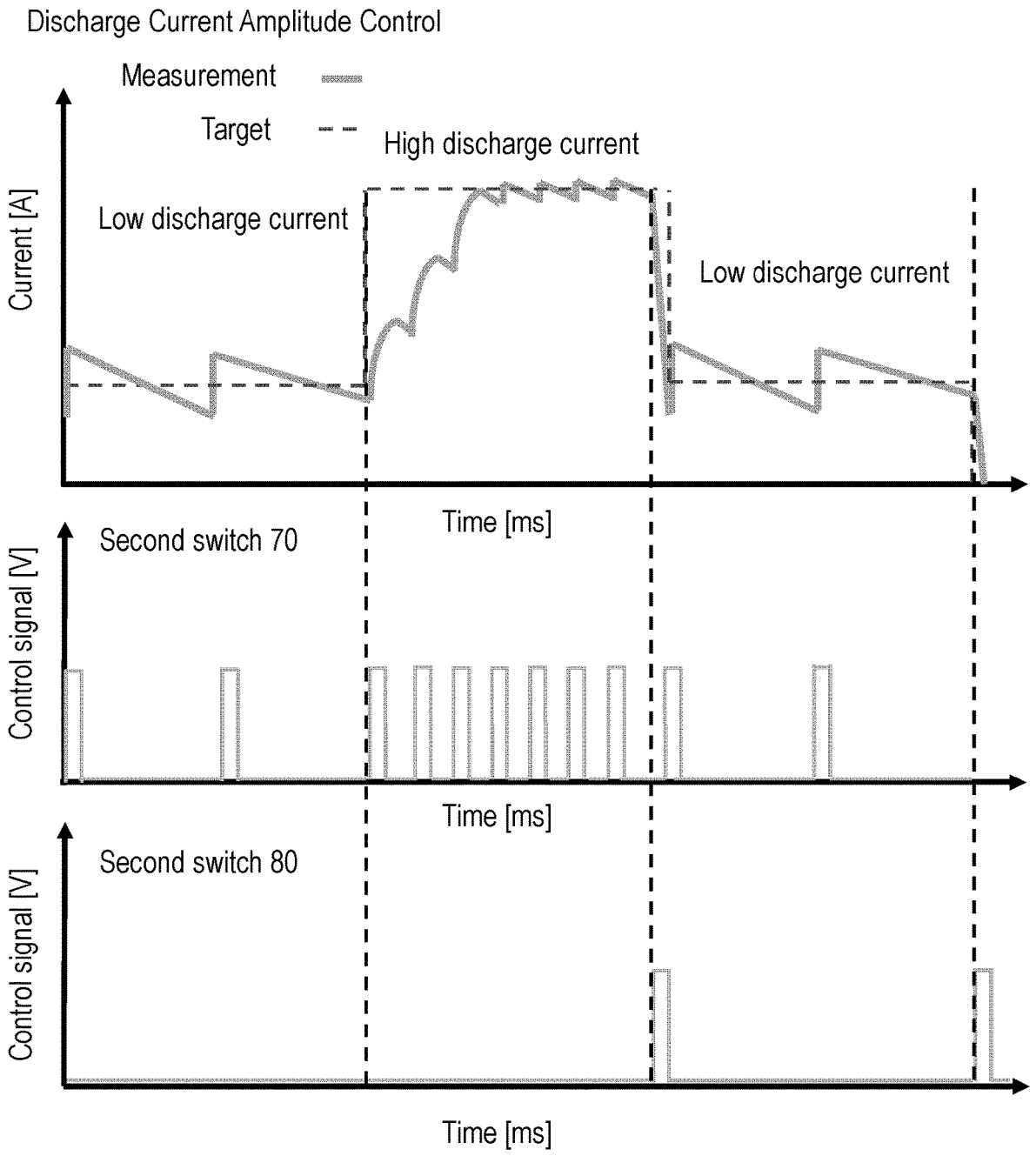
FIG. 5 is a schematic of transient control procedure of discharge current.

6. A third switch 80 is arranged between the first capacitor 50 and the common ground, as referenced with FIG. 1. When the third switch 80 is closed, the first capacitor 50 can discharge to the ground actively to reduce the voltage potential. With proper opening and closing sequence of the second switch 70 and the third switch 80, the voltage potential of the first capacitor 50 can be precisely controlled, in order to control the spark discharge current amplitude. With reference to FIG. 5, when discharge current amplitude is adjusted from low level to high level, the working frequency of the second switch 70 is increased, the third switch 80 is left open; when discharge current amplitude is adjusted from high to low level, the working frequency of the second switch 70 is decreased, and the third switch 80 is closed to actively discharge the first capacitor 50, in order to realize fast control over the discharge current.

Moreover, in order to increase the accuracy of the feedback signal of the discharge current, the direct current measurement module utilize a none-contact hall effect sensor. The ground of the module is insulated from the circuit ground, with amplifier circuit to collect the discharge current signal, in order to increase the signal to noise ratio of the discharge current measurement signal.

Embodiment 3

Embodiment 3 has similar operation principle as embodiment 1, with difference in discharge current control algorithm.

The present invention involves a spark plug heat up method via transient control of the spark discharge current. With reference to FIG. 3, the high temperature plasma channel 103 is used to heat up the central electrode 101, and the temperature and energy of the plasma channel 103 are monitored by transient control of discharge current amplitude and discharge duration. By monitoring the discharge current amplitude and discharge duration, the temperature change of the central electrode 101 and the surrounding ceramic insulator 102 can be carefully measured and controlled. This method can be used to measure the heat rating of the spark plug 100. By actively heating up the spark plug 100 via transient control of discharge current, the temperature of the surfaces of the central electrode 101 and the surrounding ceramic insulator 102 can be precisely controlled within a proper window, avoiding carbon deposit as well as realize self-cleaning.

The heating up process can start before firing the engine, using discharge current to heat up the spark plug 100 from inside, as well as cleaning the carbon deposit on the surfaces of ceramic insulator 102 and central electrode 101.

Unlike the description in embodiment 1, which uses discharge current as a feedback control signal, embodiment 3 uses the output power as the feedback signal. The feedback discharge voltage signal can also be collected, and combined with the acquired discharge current signal to calculate the transient output power of the ignition system. The physical position where feedback voltage is measured can be the same position where the discharge current is measured, i.e. the connection joint where spark plug 100 is connected with the high voltage cable of the output of the ignition coil. This method can use total discharge power as a criterion to heat up the spark plug 100 and central electrode 101. This is useful for benchmarking the heat range of spark plugs, because the temperature difference of the electrodes among spark plug with different heat ranges will be significantly different under same heating power.

Embodiment 4

Embodiment 4 has similar operation principle as embodiment 1, with difference in discharge current control algorithm.

The present invention involves a spark plug heat up method via transient control of the spark discharge current. With reference to FIG. 3, the high temperature plasma channel 103 is used to heat up the central electrode 101, and the temperature and energy of the plasma channel 103 are monitored by transient control of discharge current amplitude and discharge duration. By monitoring the discharge current amplitude and discharge duration, the temperature change of the central electrode 101 and the surrounding ceramic insulator 102 can be carefully measured and controlled. This method can be used to measure the heat rating of the spark plug 100. By actively heating up the spark plug 100 via transient control of discharge current, the temperature of the surfaces of the central electrode 101 and the surrounding ceramic insulator 102 can be precisely controlled within a proper window, avoiding carbon deposit as well as realize self-cleaning.

The heating up process can start before firing the engine, using discharge current to heat up the spark plug 100 from inside, as well as cleaning the carbon deposit on the surfaces of ceramic insulator 102 and central electrode 101.

The described precise control over the discharge energy is based on the continuous control of discharge current. Nonlinear control methods are applied to precisely control the discharge energy of the discharged current using a real-time controller (as shown in FIG. 2).

1) Identify the desired reference trajectory for the feedback control. (i.e. the desired discharge current profile, the discharge current amplitude, the change rate of discharge current, and the discharge duration.)

2) Measure the spark discharge current in real time.

3) Use the designed model to predict the spark discharge current.

Use the nonlinear controller to derive the control parameters (in this application, the duty cycle and the frequency for the control of second switch 70 based on the nonlinear cost function. To improve the transient performance of the system, an adaptive feedforward model can be used to derive a control correction based on the desired reference trajectory. The model parameters are optimized in real-time using the related measurement acquired in 1), hence the accuracy of the model prediction is improved. The ideal control input to the system can be derived using the optimized model. The final control input applied to the system is the combination of the ideal control input and the control input derived by the nonlinear feedback controller.

The system would generate different discharge current profiles based on the control input values (the control applied to the second switch 70). The discharge current feedback measurement is sent to both the feedforward model and the data-driven nonlinear model embedded in the nonlinear controller. Both models are optimized using the real-time measurement. The data-driven nonlinear model predicts the system output. Both the model prediction and the real-time feedback measurement are applied to the cost function.

The proposed control method has the robustness similar to adaptive control and the fast transient response of model based control. When the proposed control method is applied to heat up spark plug, and the overall system response time is around 2 microseconds.

The system can be used to adjust the discharged current profile to realize the conventional or any desired discharge current profile, which is one notable feature of the proposed control system. As shown in FIG. 2, the discharge current amplitude can increase during the spark discharge period (1), the discharge current amplitude is kept at a constant level during the spark discharge period (2), the discharge current amplitude can gradually reduce during the spark discharge period (3), and the discharge current amplitude can be adjusted to any desired profile (4).

The examples given above are only the technical explanation for the attached figures to this patent. Apparently, the descried examples are merely some achievable examples using the proposed system but not all its achievable applications. The terms such as "above, below, front, back, middle" used in the text are mere for the ease of explanation but not used to limit the freedom of application of the proposed system. The change of the relative direction of the terms in the texts would not affect the application of the proposed system and should still be considered as part of the proposed patent only with the exception of change in the detailed technical designs of the system. The structure, scale and the size of the figures in this text are merely used to help the explanation of the technical contents of the proposed system but are not used to limit the application of the proposed system. Hence, the change in design, the change in scale or size which would not affect the function of the propose system should still be considered as part of the proposed patent. Based on the examples given in this patent, the readers who have acquired the system without making any technical change should still be considered as belonging to the scope of protection of the present invention.

What is claimed is:

1. A spark plug heat up method via transient control of a spark discharge current, wherein a high-temperature plasma channel (103) is used to heat up a central electrode (101), and the temperature and energy of the plasma channel (103) are monitored via transient control of the discharge current; wherein by monitoring a discharge current amplitude and a discharge duration, the temperature change of the central electrode (101) and a ceramic insulator (102) are carefully measured and controlled; wherein the method comprising: measure a heat rating of a spark plug (100) by actively heating up the spark plug (100) via transient control of the continuous discharge current; and precisely control a discharge energy, the discharge duration, and the temperature of the surfaces of the central electrode (101) and the ceramic insulator (102) within a proper window to clean up a carbon deposit on the spark plug as well as realize self-cleaning.

2. The method of claim 1, wherein a heating up process takes place before the engine operation, using the discharge current to heat up the spark plug (100) from inside to control the temperature of the spark plug (100) within a preferable temperature window, and to prevent or remove the carbon deposit on the spark plug (100), the central electrode (101) and the ceramic insulator (102) generated by engine cold start.

3. The method of claim 1, wherein a stable discharge process is achieved by real-time controlling the discharge current amplitude and discharge duration of a spark event; a discharge current profile is precisely real-time controlled; the discharge current and the discharge energy during a heating up process of the spark plug (100) are controlled by a real-time current feedback; and to clean the carbon deposit by heating up the central electrode (101) of the spark plug (100) during the engine operation.

4. The method of claim 1, wherein a controllable heating up process to the central electrode (101) of the spark plug (100) is achieved by using discharge current to heat up the spark plug (100) from inside; by precise control of the discharge current and the same discharge energy, the temperature change of the central electrode (101) and the ceramic insulator (102) are carefully measured and controlled, thus to measure the heating range of the spark plug (100) and to prevent or remove the carbon deposit of the spark plug (100) mainly accumulated on the surfaces of the central electrode (101) and the ceramic insulator (102) without any modification on the spark plug (100).

5. The method of claim 1, wherein the accurate control of the discharge energy is based on the control of the discharge current amplitude and the discharge duration of a spark event.

6. The method of claim 5, wherein the continuous control of the discharge current amplitude is based on a discharge current feedback control method, using a real-time controller (10) to control a charging and discharge duration of an ignition coil (90), and the discharge duration and the discharge current amplitude of the spark event.

7. The method of claim 6, wherein the real-time controller (10) was used to control a discharge process based on the discharge current feedback control method via procedures as described below:

1) an ignition command is generated by the real-time controller (10) to close a first switch (60), in order to charge the ignition coil (90), at the end of the charging process, the first switch (60) is open to cut off a primary current, in order to generate a breakdown event at the spark gap;
2) after a discharge channel is established, a second switch (70) is closed to adjust the discharge current to a setting value via a second capacitor (40);
3) because of the voltage potential difference between the second capacitor (40) and a first capacitor (50), the first capacitor (50) is charged up by the second capacitor (40) when a second switch (70) is closed; the upstream voltage of the spark plug (100) is adjusted to control the discharge current amplitude dynamically; when the second switch (70) is open, the first capacitor (50) is used as a voltage buffer to continue supply current to the spark gap on the spark plug (100); the voltage potential of the first capacitor (50), i.e. the upstream voltage of the spark plug (100), is controlled by the operation frequency and duty cycle of the second switch (70); and the discharge current amplitude is adjusted by the voltage potential of the first capacitor (50);
4) when the second switch (70) is closed, the second capacitor (40) will discharge to the first capacitor (50) as well as the spark gap; and when the second switch (70) is open, only the first capacitor (50) will discharge to the spark gap, in order to stabilize the discharge current across the spark gap.

8. The method of claim 7, wherein the second capacitor (40) act as an energy storage device to deliver energy to the first capacitor (50) and the spark gap, and the second capacitor (40) has a relative larger capacitance compared with the first capacitor (50); the capacitance of the second capacitor (40) is around 1~2 μF which is used to stabilize voltage at the secondary side of a rectifier (20) and guarantee a stable upstream voltage for a downstream discharge circuit; and the capacitance of the first capacitor (50) is around 100 nF which is used to stabilize the discharge current across the spark gap.

9. The method of claim 7, wherein a direct current measurement module (110) measures the strength of the discharge current which as a real-time feedback signal for the real-time controller (10); and the control strategies are applied for the transient control of the discharge current includes but not limited to, a Proportional-Integral-Derivative (PID) control, a data-driven nonlinear model predictive control, a data-driven adaptive model guided control, a data-driven nonlinear model guided optimization, and an adaptive model feedforward control which speeds up the system's transient response.

10. The method of claim 7, wherein a third switch (80) is installed between the first capacitor (50) and the ground; when the third switch (80) closes, the first capacitor (50) is charged, hence the voltage difference across the first capacitor (50) is reduced; and the voltage across the first capacitor (50) is actively raised by closing the second switch (70); hence the voltage across the first capacitor (50) is flexibly altered by actuating either the second switch (70) or the third switch (80); thus the upstream voltage of the spark plug (100) is modified, and the discharge current is adjusted as the strength of the upstream voltage is shifted.

11. The method of claim 7, wherein to further enhance the accuracy of the measured feedback discharge current and suppress the influence of the electric noise originated from the spark discharge released from the spark plug (100), a Hall Effect sensor was selected to provides discharge current measurement; the Hall Effect sensor is isolated from the ground which separates a measurement circuit with a target circuit; and instrumentation amplifiers are used as a signal conditioner to improve the signal to noise ratio of the feedback current measurement.

12. The method of claim 6, wherein the power of the discharged spark is applied as a feedback for the control of a discharge current profile; by using a measured high voltage feedback signal and the discharge current, the power of the discharged spark is estimated in real-time; a voltage and current measurement are physically acquired at the same point which is the terminal of the spark plug (100); and the real-time estimate of the power of the discharged spark is used as a performance factor to control the heating of the central electrode (101) of the spark plug (100).

13. The method of claim 5, wherein the control of the discharge current amplitude and the discharge duration of the spark event are realized through a nonlinear feedback control; a cost function is designed using selected system performance parameters; and the detailed design steps for a controller are elaborated below:

1) identify a desired reference trajectory for a feedback control, the trajectory is designed based on but not limited to the following parameters: a desired spark discharge current profile, the discharge current amplitude of the discharge current, the change rate of the discharge current, and the discharge duration of the spark event;
2) measure the discharge current in real time;
3) use a designed model to predict the discharge current;
4) determine the transient and steady state requirement for a control system includes: a desired response rise time, a system overshoot allowance, and bounds for a steady state error;
5) use a nonlinear controller to derive the control parameters based on the nonlinear cost function;
6) to improve the transient performance of the system, an adaptive feedforward model can be used to derive a control correction based on the desired reference trajectory, the model parameters are optimized in real-time using a related measurement acquired in 1), hence the accuracy of a model prediction is improved, an ideal control input to the system is derived using an optimized model, and a final control input applied to the system is the combination of the ideal control input and the control input derived by the nonlinear feedback controller;
7) the system would generate different discharge current profiles based on the control input values, the discharge current feedback measurement are sent to both the feedforward model and a data-driven nonlinear model embedded in the nonlinear controller, both models are optimized using the real-time measurement, the data-driven nonlinear model predicts the system output, and both the model prediction and the real-time feedback measurement are applied to the cost function.

* * * * *